US006527042B1

(12) United States Patent
Griffon et al.

(10) Patent No.: US 6,527,042 B1
(45) Date of Patent: Mar. 4, 2003

(54) ROLL FOR THE CONTINUOUS CASTING OF METAL STRIPS COMPRISING A COOLING CIRCUIT

(75) Inventors: Jacques Griffon, Venon; Claude Breysse, St. Etienne de Grossey, both of (FR)

(73) Assignee: Pechiney Rhenalu, Paris (FR)

( * ) Notice: Subject to any disclaimer, the term of this patent is extended or adjusted under 35 U.S.C. 154(b) by 58 days.

(21) Appl. No.: 09/680,459

(22) Filed: Oct. 6, 2000

(30) Foreign Application Priority Data

Oct. 6, 1999 (FR) ..... 99 12655

(51) Int. Cl.[7] ..... B22D 11/12; B22D 11/06; B22D 11/124

(52) U.S. Cl. ..... 164/448; 164/428; 164/442; 164/443

(58) Field of Search ..... 164/448, 442, 164/485, 443

(56) References Cited

U.S. PATENT DOCUMENTS

| | | | | |
|---|---|---|---|---|
| 4,671,340 A | | 6/1987 | Larrezq et al. | 164/429 |
| 4,944,342 A | | 7/1990 | Lauener | 164/485 |
| 5,626,183 A | * | 5/1997 | Romanowski et al. | 164/428 |
| 5,642,772 A | * | 7/1997 | Charpentier et al. | 164/485 |
| 5,651,410 A | | 7/1997 | Perry et al. | 164/428 |

FOREIGN PATENT DOCUMENTS

| | | |
|---|---|---|
| GB | 1114033 | 5/1968 |

OTHER PUBLICATIONS

Patent Abstracts of Japan, Publication No. 01245947, vol. 013, No. 588, Dec. 25, 1989.

* cited by examiner

*Primary Examiner*—M. Alexandra Elve
*Assistant Examiner*—Kevin McHenry
(74) *Attorney, Agent, or Firm*—Dennison, Schultz & Dougherty

(57) ABSTRACT

The roll body (110) of the invention for a continuous casting machine is able to carry a cylindrical shell (111) in its central part and includes a cooling circuit (200), the circuit having at least one cooling liquid supply conduit (30), at least one cooling liquid evacuation conduit (40), at least one distribution collector (70), at least one evacuation collector (80), at least one distribution pipe (50, 60) connecting each collector to the corresponding conduit, and a plurality of ring channels (90) connecting the supply and evacuation collectors, the collectors and ring channels being used to place the cooling liquid circulating in the circuit in contact with the inner surface of the shell (111) such as to cool the shell, and is characterized in that the collectors (70, 80) are arranged such as to produce both in the peripheral direction and in the longitudinal direction an alternation of distribution collectors (70) and evacuation collectors (80). The invention enables the reduction of temperature heterogeneity at the surface of the shell and variations in the thickness of the strips produced by continuous casting.

20 Claims, 6 Drawing Sheets

ROLL FOR THE CONTINUOUS CASTING OF METAL STRIPS COMPRISING A COOLING CIRCUIT

FIELD OF THE INVENTION

The invention relates to the continuous casting of metal strips, in particular in aluminium or aluminium alloy. The invention particularly relates to a cooling circuit for rolls used in the continuous casting of metal strips, with which it is possible in particular to reduce thermal ovalisation (or wearing-out of round) occurring in said rolls during use.

BACKGROUND OF THE INVENTION

As illustrated in the cross-section diagram in FIG. 1, a continuous casting machine for metal strips generally contains at least two identical rolls (1A and 1B) positioned face to face, separated by a space (or gap) E having the thickness of the metal strip to be produced, which rotate in reverse direction in relation to one another. The metal 2 is supplied in liquid state from one side of the space by means of a channel 6, while the strip 3 leaves by the other side at its nominal thickness Eo. The metal solidifies between the two rolls at a point which is known as the solidification line 5.

With this type of system, it is possible to produce strips having a thickness ranging from a few centimeters to a few millimeters or less.

FIG. 2 shows the general structure of a roll of the state of the art. FIG. 2*a* is a cross-section in the rolling zone 20 that is to say in that part of the roll which comprises the shell. FIG. 2*b* corresponds to a longitudinal section view along the line of section I–I' of FIG. 2*a*.

A roll 1 typically comprises a cylindrical body 10 which, in its central part, is surrounded by a shell 11 intended to receive the molten metal and used to roll the strip, and cooling means. It is necessary for the rolls to be efficiently cooled during the rolling operation.

Cooling is usually conducted by means of a cooling liquid, typically water, circulating in at least one cooling circuit 12 placed inside the roll body 10. This circuit comprises at least a first conduit 13 intended to bring cold water F and at least a second conduit 14 intended to evacuate the heated water C. These conduits are essentially in the form of blind holes parallel to the axis 4 of the roll which emerge on one of its ends, the other end being sealed, and they extend the whole length of the shell 11. A plurality of radial pipes 15, 16 of smaller diameter connect each conduit 13, 14 to a corresponding collector 17, 18 which is in the form of a groove positioned just below the inner surface of the shell 11 and arranged parallel to the axis 4 of the roll. The collectors 17, 18 are connected to a plurality of ring-shaped channels 19 positioned just below the shell 11 in a plane that is transversal to the axis 4 of the roll. The ring-shaped channels and the collectors are generally machined-finished on the peripheral surface of the roll body 10.

Each cold-water supply conduit 13, 131, 132, and the corresponding radial pipes 15, 151, 152 and so-called distribution collector 17, 171, 172 form a cold water supply circuit. Also, each evacuation conduit for the heated water 14, 141, 142 and the corresponding radial pipes 16, 161, 162 and so-called evacuation collector 18, 191, 192 form a heated water evacuation circuit. FIG. 3 illustrates the alternation, in peripheral direction, of the supply and evacuation collectors for roll bodies of the prior art (only a few ring-shaped channels 19 are shown for reasons of clarity).

Typically each radial pipe simultaneously supplies 5 separate ring channels.

The cooling water is injected into the circuit via the cold-water supply conduits 131, 132, . . . , distributes itself in distribution collectors 171, 172, 173 . . . , via a first series of radial pipes 151, 152, . . . , enters into thermal contact with the shell at the location of collectors 171, 172, . . . , and ring channels 19, thereby ensuring cooling of the shell, is then collected in the evacuation collectors 181, 182, 183 . . . , via a second series of radial pipes 161, 162, . . . , and is then evacuated via evacuation conduits 141, 142, . . . The arrows in FIGS. 2*a* and 2*b* indicate the direction of circulation of the cooling liquid.

Generally, the rolls comprise an identical number of cold-water supply circuits and heated water evacuation circuits. The number of pairs of supply and evacuation conduits is typically two, three or four. These conduits, and their corresponding channels, are arranged symmetrically in the roll body. The case illustrated in FIG. 2 comprises two pairs of circuits which are arranged in alternate manner and staggered by 90°. In the event of three or four pairs of circuits, the angle is respectively 60° or 45°.

STATEMENT OF THE PROBLEM

With the cooling circuits of the state of the art, cold and hot zones occur in the shell and roll in the vicinity of the collectors and channels of cold water supply and heated water evacuation. This heterogeneity in temperature, which may reach 4° C., causes expansion which generates roll deformation called ovalisation or wearing-out of round. This leads to cyclical irregularities in the thickness of the cast metal strip thereby deteriorating quality. The problems caused by this defect increase with the decreasing thinness of the cast strip.

Temperature heterogeneity also modifies the real heat exchange coefficient between the metal and the shell, which produces a variation in thickness even if there is no roll deformation.

The applicant has therefore set out to find effective means, that are easy to produce or implement and are not costly, with which it is possible to overcome or minimize the temperature differences in the roll, in order to improve the quality and regularity of the thickness of the cast strip.

In order to solve this problem, the applicant put forward the solution, in French application FR 2 723 014 (corresponding to European patent application EP 694 356 and American patent U.S. Pat. No. 5,642,772), to periodically reverse the direction of circulation of the cooling liquid in the roll body, the cold liquid supply circuit becoming the evacuation circuit for the heated liquid, and vice versa. This solution, with which it is possible to considerably reduce wearing-out of round without having to change the rolls, nonetheless requires adaptation of the outer cooling circuit and the operating mode of the machine. In particular, the transitory operating conditions and/or the frequency of reversing the direction of circulation are dependent upon the type of alloy.

The applicant therefore set out to find solutions which remedy the drawbacks of the prior art and which in particular are able to reduce or even eliminate resulting temperature heterogeneity and variations in strip thickness.

SUMMARY OF THE INVENTION

The roll body of the invention for a continuous casting machine is able, in its central part—the so-called rolling zone, to carry a cylindrical shell and comprises a cooling circuit, which circuit comprises at least one cooling-liquid supply conduit, at least one cooling-liquid evacuation conduit, at least one distribution collector, at least one evacuation collector, at least one distribution pipe connecting each collector to the corresponding conduit, and a plurality of ring channels connecting the supply and evacuation collectors, said collectors and ring channels being used to place the cooling liquid circulating in said circuit in contact with the inner surface of the shell to ensure its cooling, and is characterized in that the collectors are arranged such as to produce, both in the peripheral direction and in the longitudinal direction, an alternation of distribution collectors and evacuation collectors.

The applicant had the idea of modifying the inner cooling circuit of the rolls so as to provide the alternation, preferably the close alternation, of the cold liquid arrival zones F and the heated liquid evacuation zones C, in both directions of the surface of the shell, that is to say both in the peripheral direction and in the longitudinal direction.

The applicant considers that this particular configuration of the cooling circuit, which does not significantly increase product manufacturing costs, produces an alternation of cold and hot zones below the inner surface of the shell which is able to promote a substantial reduction in temperature heterogeneity of the outer surface of the shell. The applicant also found that, surprisingly, the recourse to a plurality of collectors leads to greater uniformity in the flow of cooling liquid in the channels.

According to the preferred embodiment of the invention, the collectors are in the form of grooves, whose length is distinctly smaller than the length Lf of the shell, and which are aligned according to generatrix lines, angularly equidistant, and are connected to the supply and evacuation conduits in such manner as to produce an arrangement of the collectors in a regular network, even a chequered pattern.

A further object of the invention is a roll for a continuous casting machine comprising a shell and a roll body of the invention.

A further object of the invention is a continuous casting machine comprising at least one roll of the invention.

Yet a further object of the invention is a method for cooling continuous casting rolls in which the direction of circulation of the cooling liquid circulating in at least one roll of the invention is periodically reversed.

DETAILED DESCRIPTION OF THE INVENTION

Figure 6A:
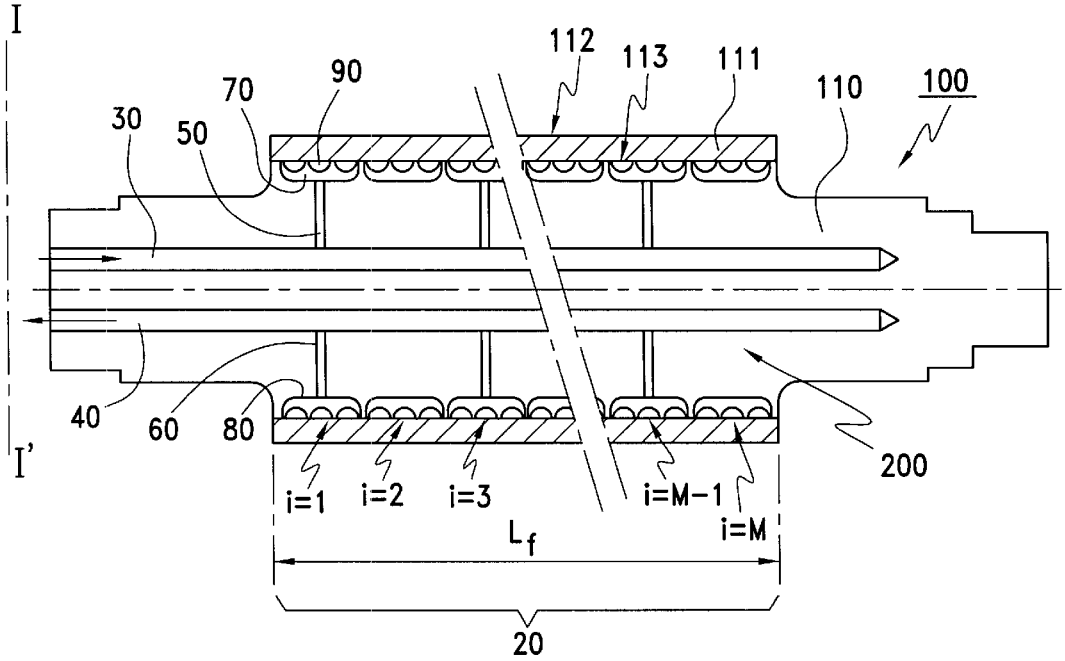
FIG. 6 shows two longitudinal sections of a roll body of the invention (planes I–I' and II–II') of FIG. 5).
Figure 6B:
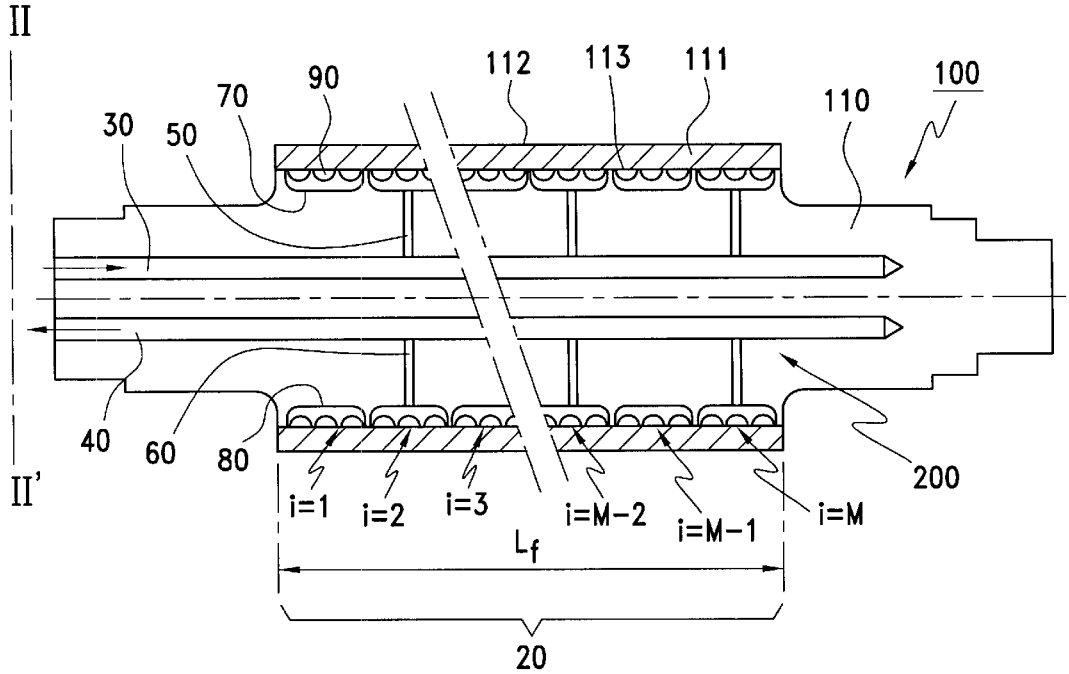

In order to simplify the disclosure, those elements having the same function, such as the distribution collectors and supply conduits, are also collectively denoted by the generic references given in FIG. 6. For example, therefore, when no specific element is concerned, the distribution collectors 7101, 7102, 7103, . . . may be denoted collectively by the reference 70, and the supply conduits 31, 32, 33, . . . may be collectively denoted by the reference 30.

The roll body 110 of the invention for a continuous casting machine is able, in its central part —the so-called rolling zone 20, to carry a cylindrical shell 111 and comprises a cooling circuit 200, said circuit comprising at least one cooling liquid supply conduit 30, at least one cooling liquid evacuation conduit 40, at least one distribution collector 70, at least one evacuation collector 80, at least one distribution pipe 50, 60 connecting each collector to the corresponding conduit, and a plurality of ring-shaped channels 90 connecting the supply and evacuation collectors, said collectors and ring channels being used to place the cooling liquid circulating in said circuit in contact with the inner surface of the shell 111 such as to cool the latter, and is characterized in that the collectors 70, 80 are arranged such as to produce an alternation, both in the peripheral direction and in the longitudinal direction, of distribution collectors 70 and evacuation collectors 80.

In other words, the collectors are arranged under the surface of the shell so that they can for example form sequences 70/80/70/80 . . . both in the peripheral direction and in the longitudinal direction.

In order to simplify the circuit, the number of supply and evacuation conduits is preferably an even number (typically 2, 4 or 6), which in practice means that it is possible to have a number of supply conduits equal to the number of evacuation conduits. In this manner, the supply and evacuation conduits may be arranged alternately around a circle (in cross section); the same applies to the collectors connected to the latter. The number Na of supply conduits 30 is preferably equal to the number Ne of evacuation conduits 40.

Preferably, the total number of collectors is a whole multiple M of the total number of conduits. More specifically, it is advantageous for the number of distribution collectors to be a whole multiple M of the number of supply conduits and for the number of evacuation collectors to be the same whole multiple M of the number of evacuation conduits, in which M is 2 or more. With this choice it is possible to simplify the design and practical implementation of the cooling circuit. In this case, each supply conduit may be connected to M separate distribution collectors, and each evacuation conduit may be connected to M separate evacuation collectors. For example, if the circuit comprises three supply conduits and three evacuation conduits, and if each conduit is connected to 6 collectors (M=6), then the total number of collectors is 36.

The supply conduits 30 and evacuation conduits 40 are separate and distinct. The conduits are preferably in the form of blind holes substantially parallel to the axis 4 of the roll, and lead to one of the ends of the roll, the other end being sealed, and extend over substantially the entire length of the shell 111. It is also advantageous to distribute the conduits 30, 40 symmetrically around the axis 4 of the roll. The conduits 30, 40 are preferably the same distance from the axis 4. These arrangements simplify in particular the manufacture of the roll body.

The circuit of the invention may comprise any number of pairs of supply and evacuation conduits. So as to obtain optimal temperature homogeneity on the surface of the shell, the circuit of the invention preferably comprises at least two pairs of supply and evacuation conduits staggered at an angle $\alpha$ of 360°/N, in which N is the total number of conduits. For example, if the circuit comprises three supply conduits and three evacuation conduits, then N equals 6 and the angle $\alpha$ is 60°.

The collectors 70, 80 typically have the shape of an elongated groove positioned just below the inner surface 113 of the shell 111 and whose major axis is preferably substantially parallel to the axis 4 of the roll. The number of separate collectors connected to each conduit, which is at least 2, is determined in relation to the length of the shell so as to permit efficient homogenisation of the temperature of the outer surface 112 of the shell.

The length of the collectors 70, 80 is distinctly smaller than the length Lf of the shell 111, and more precisely their length is no more than approximately one half of the length of the shell. According to the preferred embodiment of the invention, the collectors 70, 80 are of substantially the same length Lc.

The collectors 70, 80 are connected to a plurality of ring channels 90 positioned just below the surface of the shell 111 in transverse planes to the axis 4 of the roll. These channels connect each distribution collector 70 to at least one evacuation collector 80 and cause the cooling liquid in contact with the inner surface 113 of the shell 111 to circulate in such manner as to produce efficient cooling of the shell. The ring channels are preferably equidistant so as to promote greater homogeneity of cooling.

The number and section of the distribution pipes 50, 60 are adjusted such as to ensure satisfactory load loss in the circuit, satisfactory flow in the ring channels 90, and specific distribution (generally uniform) of the cooling liquid along the shell. On this account, the cross section of the distribution pipes 50, 60 is preferably smaller than that of the conduits.

According to the invention, the collectors advantageously form a regular network under the surface of the shell 111, so that each distribution collector 70 alternates with at least one evacuation collector 80 in the longitudinal direction and the peripheral direction. The regularity of the network provides greater control over temperature homogeneity.

For the purpose of simplifying the fabrication of the circuit, the collectors are preferably arranged in linear rows along a generatrix of the roll, that is to say in longitudinal rows. In this case, the conduits 30, 40 are advantageously connected to collectors 70, 80 in different rows, and are preferably connected solely to collectors 70, 80 in adjacent rows. The number of rows of collectors 70, 80 is advantageously equal to the number of conduits 30, 40, which allows simplification of the circuit of the invention.

The number Nc of separate collectors in one row, which is at least 2, is determined in relation to the length of the shell, so as to allow efficient temperature homogenization on the surface of said shell. The length Lc of each collector is then slightly smaller than Lf/Nc, in which Lf is the length of the shell. In order to simultaneously ensure homogeneous shell cooling and efficient complementary mechanical support, the collectors in one row are preferably separated by a distance of between approximately 5 and 25% of their length.

The cooling liquid is injected into the circuit via cold liquid supply conduits 30, distributes itself in distribution collectors 70 via a first series of distribution pipes 50, enters into thermal contact with the shell 111, at the location of collectors 70 and ring channels 90, on the inner surface 113 of the shell 111 ensuring its cooling, and is then collected in evacuation collectors 80 via a second series of distribution pipes 60, and is then evacuated by the evacuation conduits 40. The heat energy absorbed by the shell on its outer surface 112 during the continuous casting operation, is therefore transmitted to the cooling liquid and evacuated outside the roll via the cooling circuit.

The invention is particularly adapted to casting rolls whose shell has a thickness of between 20 and 100 mm.

In order to increase temperature homogeneity, the method of cooling the continuous casting rolls may comprise the use of a roll of the invention and periodical reversal of the direction of circulation of the liquid in the roll circuit, that is to say that the supply conduits periodically become evacuation conduits and the distribution collectors periodically become evacuation collectors, and vice versa, as described in application FR 2 723 014.

PREFERRED EMBODIMENT OF THE INVENTION

Figure 1:
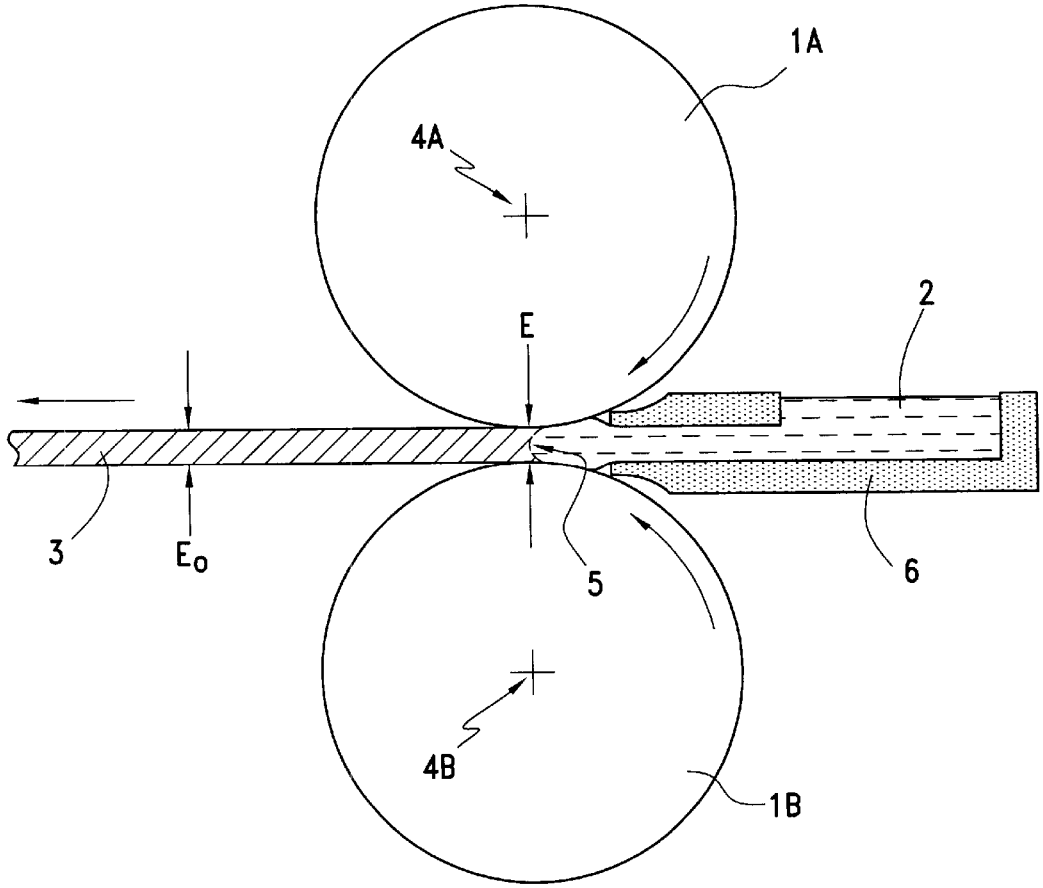
FIG. 1 shows a diagram of the basic elements of a continuous casting machine.
Figure 2B:
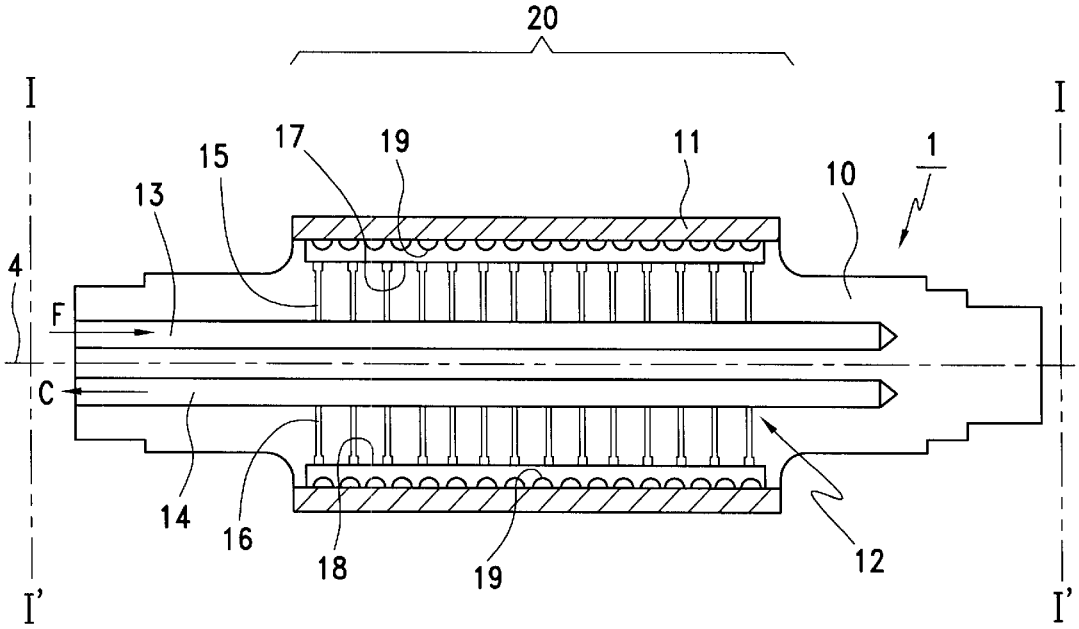
FIG. 2b (PRIOR ART)
FIG. 2 illustrates a continuous casting roll of the prior art.
Figure 2A:
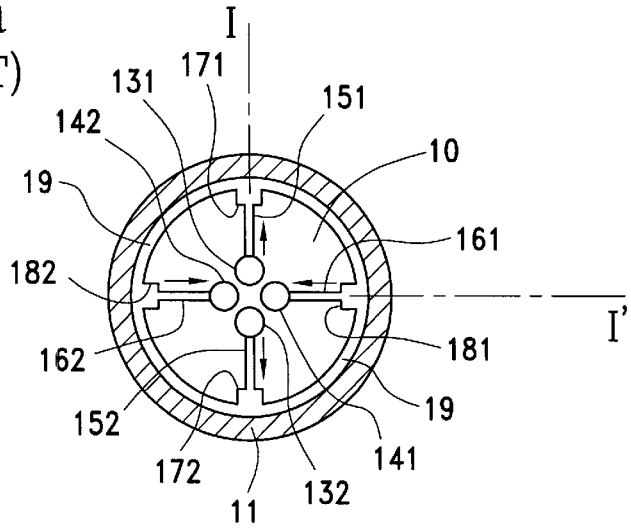
FIG. 2a (PRIOR ART)
Figure 3:
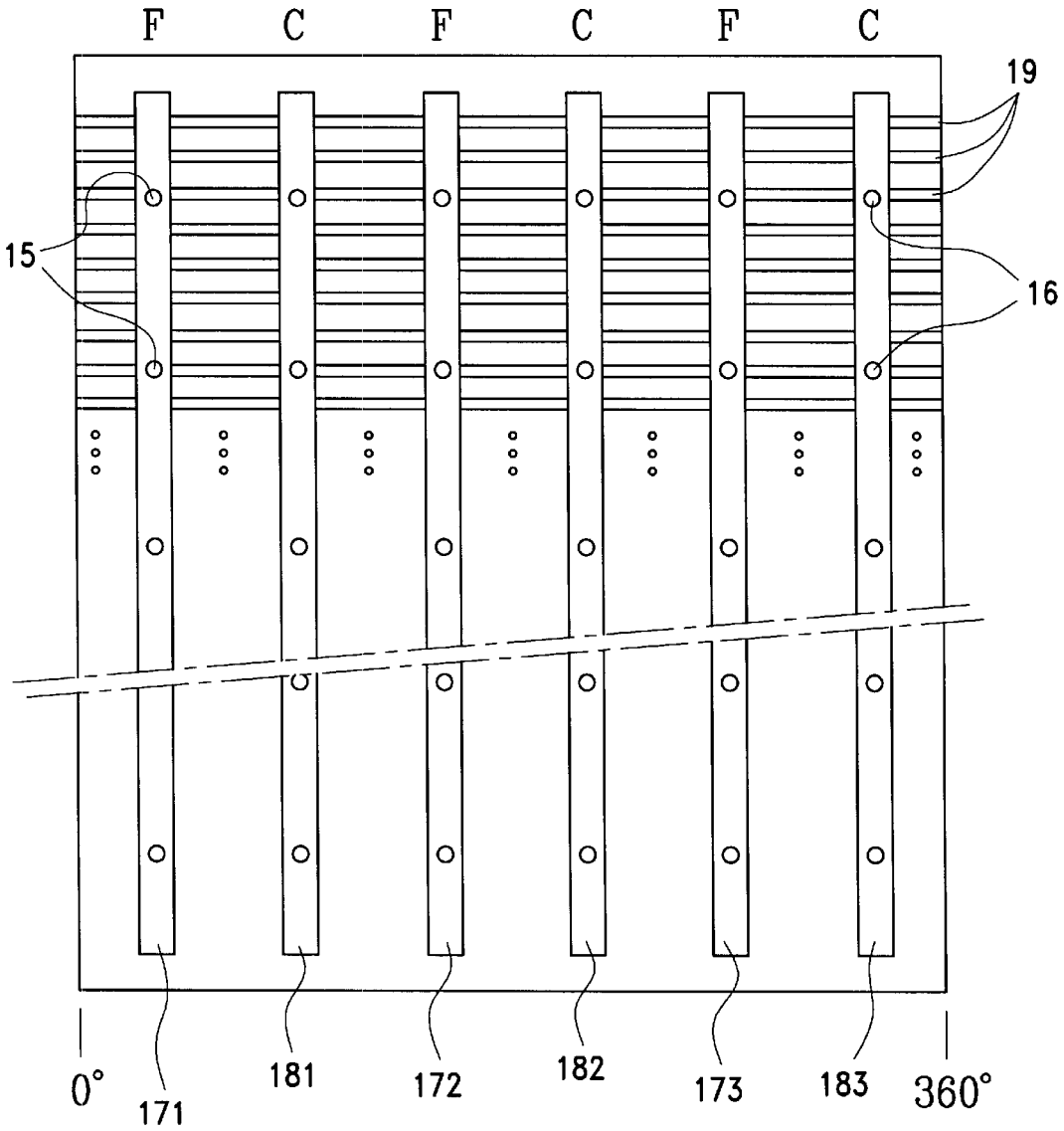
FIG. 3 gives a flat view, for a roll of the prior art, of that part of the surface of the roll body positioned below the shell (rolling zone).
Figure 4:
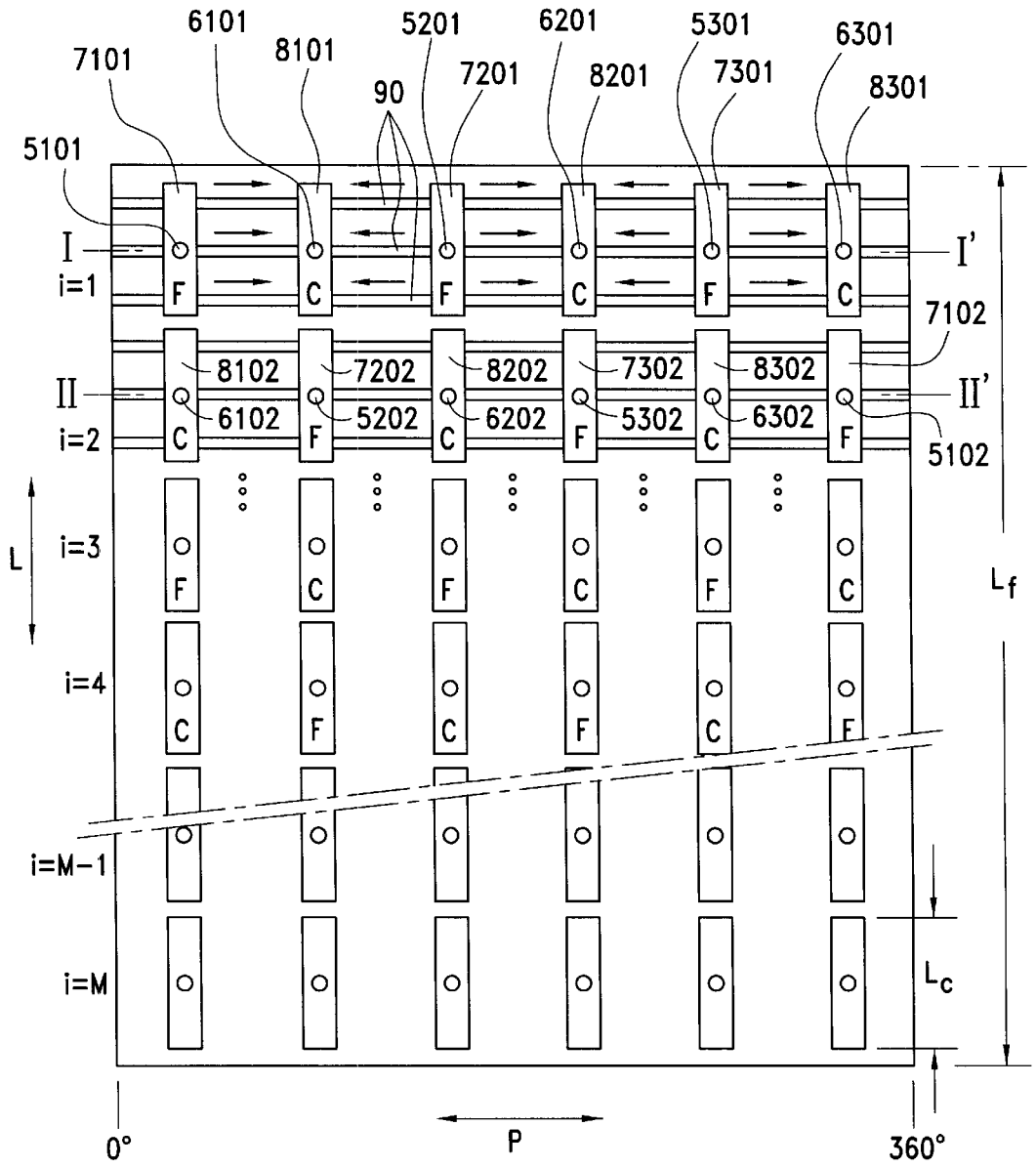
FIG. 4 gives a flat view, for a roll body of the invention, of that part of the surface of the roll body positioned below the shell (rolling zone).

In the preferred embodiment of the invention, of which one particular case is shown in FIGS. 4 to 6, the collectors 70, 80 only extend under a small part of the shell 111 (over less than one half of its length) and the collectors are distributed over the surface of the roll body such as to form rows of collectors which are preferably aligned along a generatrix and form a regular network of collectors. The collectors positioned along a generatrix are separated angularly by an angle $\alpha$ in relation to those of the neighbouring generatrix.

FIGS. 4 to 6 illustrate a cooling circuit comprising three supply conduits, three evacuation conduits arranged alternately, and 20 collectors per row. The number of rows of aligned collectors is then equal to the total number of conduits, namely N=6. In this case, for example, the separate collectors connected to the cold liquid supply conduit 31 are collectors 7101, 7102, 7103, . . . 7120, the separate collectors connected to the cold liquid evacuation conduit 41 are collectors 8101, 8102, 8103, . . . 8120), etc. In more detail, cold liquid supply conduit 31 is connected to collectors 7101, 7102, . . . through distribution pipes 5101, 5102, . . . , respectively; cold liquid supply conduit 32 is connected to collectors 7201, 7202, . . . through distribution pipes 5201, 5202, . . . , respectively; and cold liquid supply conduit 33 is connected to collectors 7301, 7302, . . . through distribution pipes 5301, 5302, . . . , respectively. Similarly, heated liquid evacuation conduit 41 is connected to collectors 8101, 8102, . . . through distribution pipes 6101, 6102, . . . , respectively; heated liquid evacuation conduit 42 is connected to collectors 8201, 8202, . . . through distribution pipes 6201, 6202, . . . , respectively; and heated liquid evacuation conduit 43 is connected to collectors 8301, 8302, . . . through distribution pipes 6301, 6302, . . . , respectively. The distribution collectors alternate with the evacuation collectors positioned along the same generatrix and along a neighbouring generatrix. The angle $\alpha$ separating two rows of collectors is then 60°.

FIG. 4, which gives a flat view of that part of the surface of the roll body which is positioned below the shell (corresponding to the rolling zone 20) shows the chequered arrangement of the supply and evacuation collectors of the rolls in the preferred embodiment of the invention. The letters F and C respectively denote the cold liquid arrival zones and heated liquid evacuation zones. For clarity of the figures, only a few ring channels 90 are illustrated. The arrows P and L respectively indicate the peripheral direction and longitudinal direction. The numbering of the references given to the distribution collectors 70 and evacuation collectors 80 follows a matrix: the first FIG. (7 or 8) corresponds to the type of collector (supply or evacuation), the second figure corresponds to the conduit 30 or 40 to which the collector is connected, and the third and fourth figures correspond to the row i in which the collector is positioned. For example, the evacuation collector denoted 8302 is connected to the evacuation conduit denoted 43 and is positioned in row i=2.

Figure 5A:
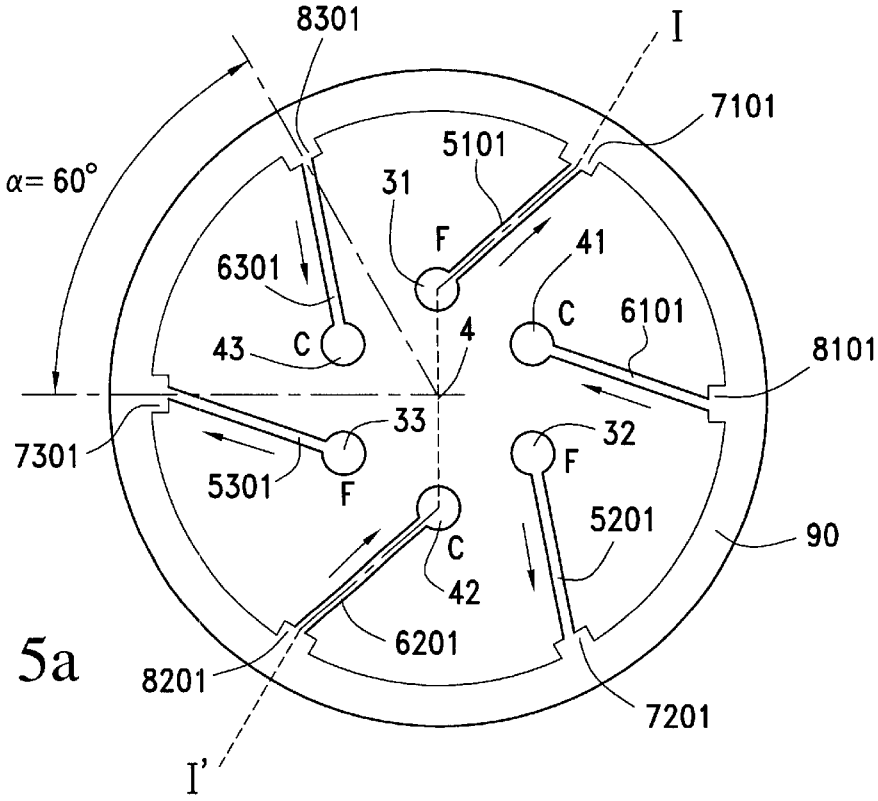
FIG. 5 shows two cross-section views of a roll body of the invention passing through the distribution pipes (planes I–I' and II–II' of FIG. 4)
Figure 5B:
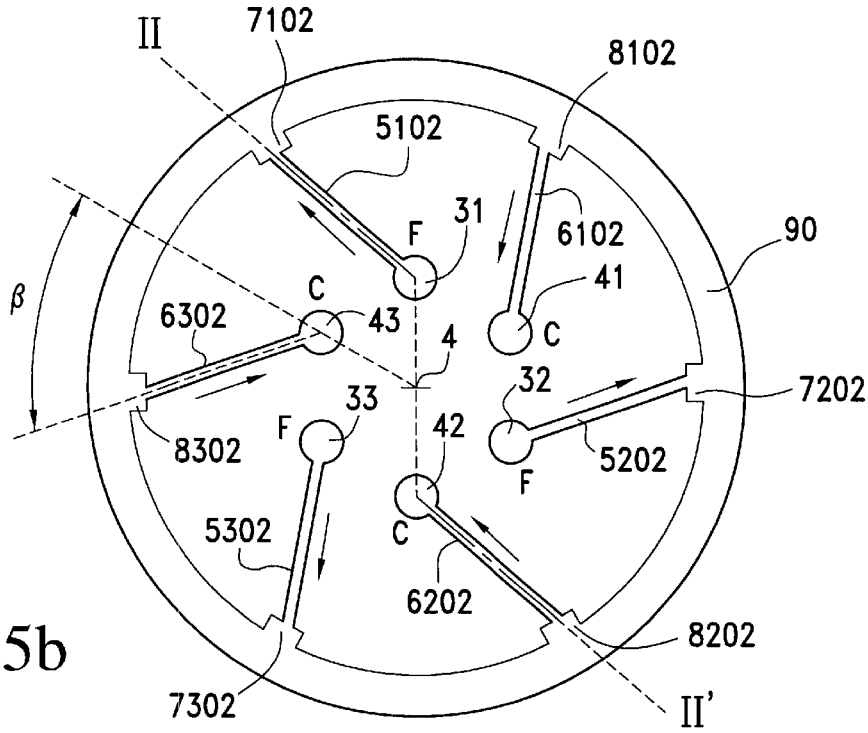

FIG. 5 shows a cross section of the roll body corresponding to this embodiment of the invention. FIGS. 5*a* and 5*b* respectively relate to section planes I–I' and II–II' of FIG. 4, and more generally to even alternations (i=2, 4, 6, . . . ) and uneven alternations (i=1, 3, 5 . . . ) of the collectors connected to each conduit (apart from the references which must be incremented accordingly, that is to say for example that reference 7101 of FIG. 5*b* becomes reference 7103 for the section corresponding to i=3, reference 7105 for the section corresponding to i=5, etc).

In this embodiment, the cooling circuit may be divided into identical parts or sections as illustrated in FIG. 5, which repeat themselves along the length of the roll such as to produce an alternate pattern of collectors. With this configuration, it is possible to alternately connect each supply conduit or evacuation conduit to corresponding collectors positioned either side of the conduit so as to form a regular network. The mesh size of this network is determined by the number of collectors and conduits.

As shown in FIG. 5, the conduits are then advantageously staggered at an angle in relation to the corresponding collectors so that they are positioned at the same distance from all the collectors to which they are connected. In this case, the distribution pipes 50, 60 which connect the conduits 30, 40 to the collectors 70, 80 may be inclined at an angle β in relation to a radial axis passing through the corresponding conduit or collector.

FIG. 6 shows two longitudinal sections of a roll body of the preferred embodiment of the invention. These sections respectively correspond to planes I–I' of FIG. 5*a* and II–II' of FIG. 5*b*. The arrows indicate the direction of circulation of the cooling liquid.

In this embodiment, the collectors 70, 80 are preferably of substantially the same length Lc, which particularly allows simplification in the design of the cooling circuit.

The applicant estimates that with this type of configuration the temperature differences on the surface of the shell should remain less than 0.5° C. in relation to the maximum temperature of this surface, which may be more than 500° C. Under the same conditions, but with a cooling circuit of the prior art, the maximum temperature difference is rather 4° C. which causes variations in strip thickness of 0.04 mm attributable to wearing-out of the round of the rolls.

The applicant also estimated the channel flow differences in respect of typical rolls comprising a shell with a diameter of 1150 mm and a thickness of 80 mm, and with a cooling circuit comprising three supply conduits and three alternate evacuation conduits, substantially parallel to the axis of the roll and separated by an angle of 60°, and six collectors arranged over 6 generatrix lines separated by an angle of 60°. In one case, corresponding to the prior art, with a roll comprising 17 radial pipes and 85 ring channels (i.e. 5 ring channels per radial pipe) whose collectors typically have a length of 2050 mm, a depth of 10 mm, a width of 20 mm, the applicant estimated that the flows of the channels close to the radial pipes was approximately twice that of the channels the furthest from the radial pipes. In one typical configuration of the invention, as illustrated in FIGS. 4 to 6 which, on each of the 6 generatrix lines, comprises 23 collectors having a length of 75 mm, a depth of 8 mm and a width of 14 mm, the collectors being arranged in rows along the 6 generatrix lines, and which comprises 3 ring channels for each collector, the applicant estimated that flow was substantially the same in all the channels.

ADVANTAGES

The invention is of particular advantage in the production of thin strips, that is to say having a thickness of less than 5 mm when the detriment caused by roll ovalization is greater the thinner the thickness of the strip.

The invention also has the advantage of providing more uniform mechanical support for the shell through the presence of discontinuities in the collectors along shell length. This configuration improves shell resistance to mechanical fatigue by limiting the surface of bending areas.

What is claimed is:

1. Roll body for a continuous casting machine able, in its central part the so-called rolling zone, to carry a cylindrical shell and comprising a cylindrical outer surface and a cooling circuit, said circuit comprising at least one cooling liquid supply conduit, at least one cooling liquid evacuation conduit, a plurality of distribution collectors recessed into said outer surface and having a first depth, a plurality of evacuation collectors recessed into said outer surface, wherein each of said plurality of distribution collectors and each of said plurality of evacuation collectors has a substantially equal length $L_c$, at least one distribution pipe connecting each collector to the corresponding conduit, and a plurality of ring channels recessed into said outer surface, having a second depth less than said first depth and connecting the plurality of distribution and evacuation collectors, said plurality of distribution and evacuation collectors and ring channels being used to place the cooling liquid circulating in said circuit in contact with the inner surface of the shell to cool the shell, said body being characterized in that the plurality of distribution and evacuation collectors are arranged in an alternating configuration both in the peripheral direction and in the longitudinal direction, and wherein each of said plurality of distribution and evacuation collectors is separated from one another in the longitudinal direction by a distance of about 5% to 25% of said length $L_c$.

2. Body according to claim 1, characterized in that the total number of said conduits is even.

3. Body according to claim 1, characterized in that the total number of collectors (70, 80) is a whole multiple M of the total number of conduits (30, 40), M being 2 or more.

4. Body according to claim 3, characterized in that each supply conduit (30) is connected to M separate distribution collectors (70), and in that each evacuation conduit (40) is connected to M separate supply collectors (80).

5. Body according to claim 1, characterized in that the collectors (70, 80) are in the shape of elongated grooves.

6. Body according to claim 5, characterized in that the collectors (70, 80) are of substantially the same length Lc.

7. body according to claim 5 characterized in that the major axis of the collectors is substantially parallel to the axis of the roll body.

8. Body according to claim 1, characterized in that the collectors (70, 80) form a regular network below the surface of the shell (111).

9. Body according to claim 1, characterized in that the collectors (70, 80) are arranged in longitudinal rows below the shell (111).

10. Body according to claim 9, characterized in that the supply conduits (30) and evacuation conduits (40) are respectively connected to distribution collectors (70) and evacuation collectors (80) in different rows.

11. Body according to claim 9, characterized in that the conduits (30, 40) are solely connected to collectors (70, 80) in adjacent rows.

12. Body according to claim 9, characterized in that the number of rows of collectors (70, 80) is equal to the total number of conduits (30, 40).

13. Roll of a continuous casting machine comprising a shell (111) and a body (110) according to claim 1.

14. Continuous casting machine comprising at least one roll according to claim 13.

15. Method for cooling continuous casting rolls characterized in that the direction of circulation of the liquid in the cooling circuit (200) of at least one roll according to claim 13 is periodically reversed.

16. Body according to claim 1, characterized in that the total number of said conduits is equal to 2, 4 or 6.

17. Roll body for a continuous casting machine adapted to support a cylindrical shell and comprising a longitudinal axis, a cylindrical outer wall and a cooling circuit, said cooling circuit comprising:

at least one cooling liquid supply conduit, at least one cooling liquid evacuation conduit, a plurality of longitudinally extending distribution collectors recessed into said outer surface and having a first depth, a plurality of longitudinally extending evacuation collector recessed into said outer surface, wherein each of said plurality of distribution collectors and each of said plurality of evacuation collectors has a substantially equal length $L_c$, at least one distribution pipe connecting each collector to the corresponding conduit, and a plurality of circumferentially extending ring channels recessed into said outer surface and having a second depth less than said first depth and connecting the supply and evacuation collectors, wherein said distribution collectors and said evacuation collectors alternate circumferentially around and longitudinally along the body, and wherein each of said plurality of distribution and evacuation collectors is separated from one another in the longitudinal direction by a distance of about 5% to 25% of said length $L_c$.

18. Roll body for a continuous casting machine adapted to support a cylindrical shell having a longitudinal axis and a cooling circuit, said cooling circuit comprising:

at least one cooling liquid supply conduit, at least one cooling liquid evacuation conduit, a first plurality of elongated distribution collectors;

a first plurality of elongated evacuation collectors;

wherein each of said first plurality of distribution collectors and said first plurality of evacuation collectors has a substantially equal length $L_c$, said first plurality of elongated distribution collectors and said first plurality of elongated evacuation collectors longitudinally alternate along and circumferentially alternate around said cylindrical shell, and wherein each of said plurality of distribution and evacuation collectors is separated from one another in the longitudinal direction by a distance of about 5% to 25% of said length $L_c$;

at least one distribution pipe connecting each collector to the corresponding conduit, and a plurality of circumferentially extending ring channels connecting the supply and evacuation collectors.

19. Roll body of claim 18 further including a second plurality of elongated, longitudinally extending and aligned and alternating distribution collectors and evacuation collectors arranged such that the second plurality of evacuation collectors are aligned circumferentially with said first plurality of distribution collectors.

20. Roll body of claim 18 wherein said evacuation collectors or said distribution collectors connect at least three ring channels.

* * * * *